US006568213B2

(12) United States Patent
Butler

(10) Patent No.: US 6,568,213 B2
(45) Date of Patent: May 27, 2003

(54) ADJUSTABLE JEWELRY BEZEL SETTING

(75) Inventor: Jerome D. Butler, Great Neck, NY (US)

(73) Assignee: Alfred Butler, Inc., New York, NY (US)

( * ) Notice: Subject to any disclaimer, the term of this patent is extended or adjusted under 35 U.S.C. 154(b) by 135 days.

(21) Appl. No.: 09/747,249

(22) Filed: Dec. 21, 2000

(65) Prior Publication Data

US 2002/0078708 A1 Jun. 27, 2002

Related U.S. Application Data

(60) Provisional application No. 60/208,333, filed on May 31, 2000.

(51) Int. Cl.[7] ..... A44C 17/02

(52) U.S. Cl. ..... 63/26; 63/27; 63/29.1; 63/31

(58) Field of Search ..... 63/26, 27, 29.1, 63/31

(56) References Cited

U.S. PATENT DOCUMENTS

| | | | | | |
|---|---|---|---|---|---|
| 832,887 | A | * | 10/1906 | Wittstein | 63/27 |
| 2,811,024 | A | * | 10/1957 | Thompson | 63/26 |
| 4,835,987 | A | * | 6/1989 | Magnien et al. | 63/28 |
| 6,038,751 | A | * | 3/2000 | Butler | 29/10 |

* cited by examiner

*Primary Examiner*—J. J. Swann
*Assistant Examiner*—Andrea Chop
(74) *Attorney, Agent, or Firm*—Gottlieb, Rackman & Reisman, P.C.

(57) ABSTRACT

A bezel setting for a ring or other jewelry item is provided. The bezel setting is mounted along the jewelry item and includes a first bezel element and a facing second bezel element for defining an opening therebetween in which a jewelry stone is received. The bezel elements are movable with respect to one another in order to be able to selectively adjust the distance between the bezel elements, and thus the size of the opening. As a result, the bezel setting can accommodate jewelry stones of varying size.

27 Claims, 5 Drawing Sheets

FIG. 3
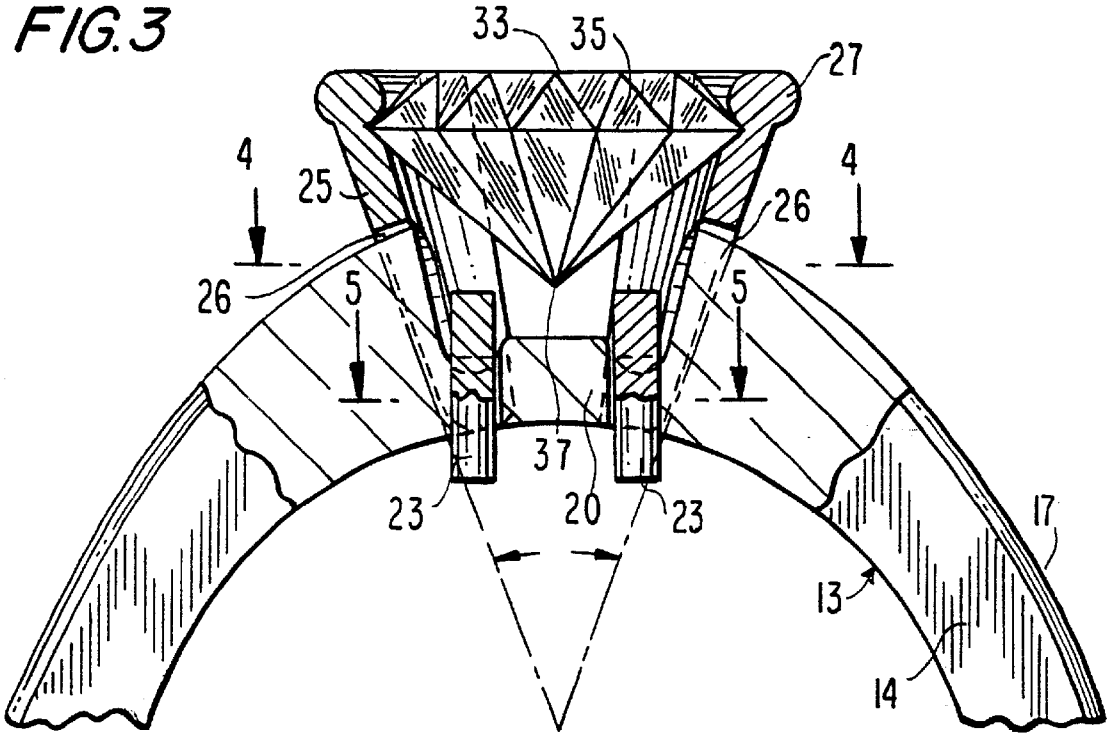
FIG. 4
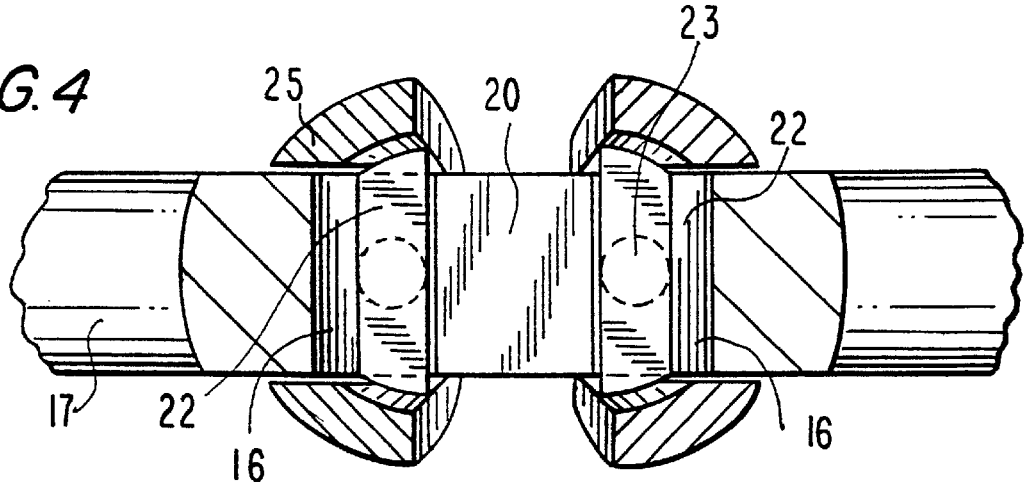
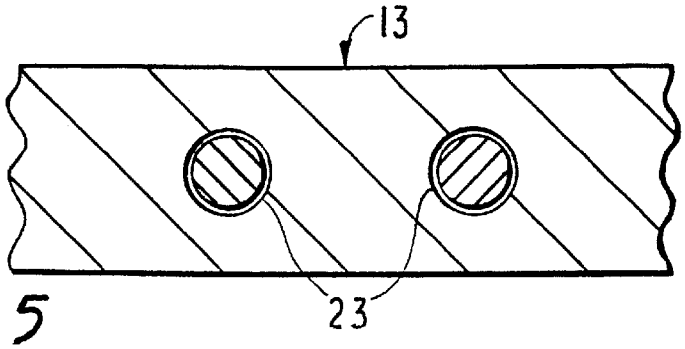
FIG 5

FIG. 8
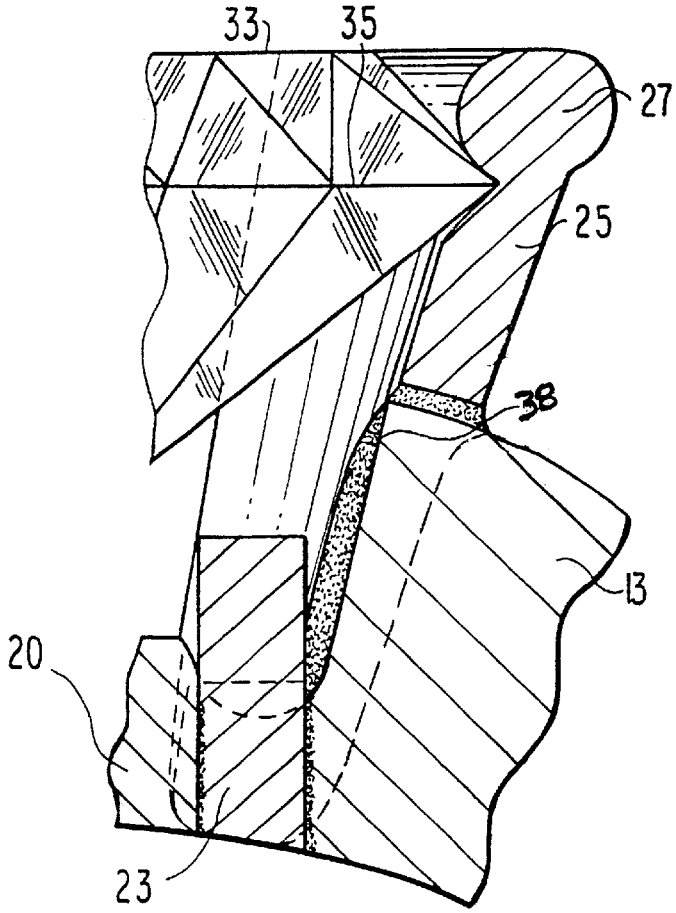
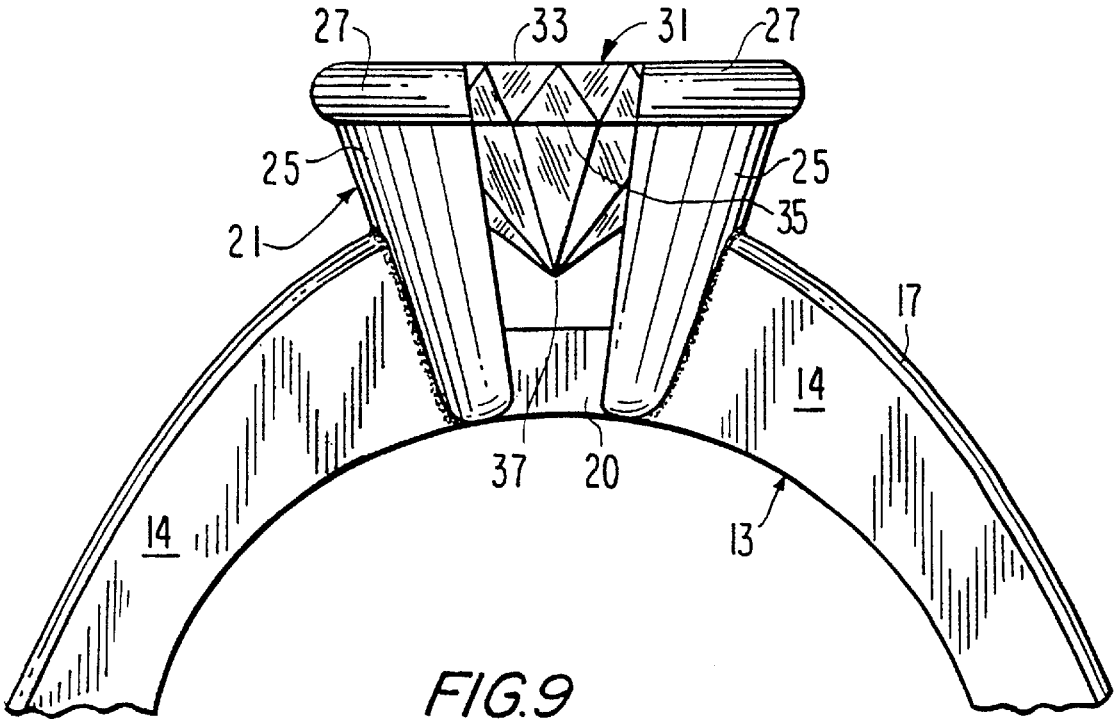
FIG. 9

ADJUSTABLE JEWELRY BEZEL SETTING

This application claims benefit of Ser. No. 60/208,333 May 31, 2000.

BACKGROUND OF THE INVENTION

This invention relates to a setting for a jewelry item, and more particularly, to an adjustable bezel or prong setting for accommodating different size jewelry stones.

In the jewelry trade, bezel or prong settings are used to hold and retain diamonds and other types of precious or semi-precious stones. Presently, bezel or prong settings are fixed in position with respect to the jewelry item, and therefore different bezel sizes (openings) are required for different size stones. Bezel or prong settings usually come in ¼ carat (4 m/m), ⅜ carat (4½ m/m), one-half carat—⅝ carat—¾ carat—1 carat—all the way up to about 2 carats. For each size, there is a ½ m/m increase. Moreover, even with the ½ m/m separation, the stone that is used often does not fit appropriately.

The problem with the prior art bezel and prong settings is that it is necessary to have a different size setting for each ring or other jewelry item in order to cover the various range of stone sizes. Moreover, even having different size settings is less than desirable, since some stones may not fit appropriately within the bezel or prong setting.

Accordingly, it is desirable to provide a bezel or prong type setting for a ring or other jewelry item which overcomes the above disadvantages and enables the easy retention of various size jewelry stones.

SUMMARY OF THE INVENTION

Generally speaking, in accordance with the invention, a bezel or prong setting for a ring or other jewelry item is provided. The bezel or prong setting is mounted along the jewelry item and includes a first bezel or prong element and a facing second bezel or prong element for defining an opening therebetween in which a jewelry stone is received. The bezel or prong elements are movable with respect to one another in order to be able to selectively adjust the distance between the bezel or prong elements, and thus the size of the opening. As a result, the bezel or prong setting can accommodate jewelry stones of varying size.

Preferably, the bezel or prong elements of the setting are movable with respect to one another by being pivotally attached along the jewelry item. In particular, each bezel or prong element has a depending flexible pin element coupled to the jewelry item. Each pin element is received in a hole formed in the jewelry unit and can flex in both a forward and back direction. As a result, each bezel or prong element is adjustable in both a forward and back direction so that the setting is capable of receiving different size jewelry stones.

After the bezel or prong elements for any given jewelry item have been moved or positioned as directed, each bezel or prong element, including its corresponding depending pin element, is soldered and/or bonded in position.

Accordingly, it is an object of the invention to provide an improved bezel or prong setting for a jewelry item.

Still another object of the invention is to provide a bezel or prong setting for a jewelry item which can accommodate various size jewelry stones.

Still a further object of the invention is to provide a bezel or prong setting for a jewelry item in which the bezel elements thereof may be adjusted in position therealong.

Yet another object of the invention is to provide a bezel or prong setting for a jewelry item in which a jewelry stone fits correctly therewithin.

Still other objects and advantages of the invention will in part be obvious and will in part be apparent from the following description.

The invention accordingly comprises the features, elements and parts as described in the following description, and the scope of the invention will be indicated in the claims.

BRIEF DESCRIPTION OF THE DRAWINGS

For a fuller understanding of the invention, reference is made to the following description taken in connection with the accompanying drawings, in which:

FIG. 3 is a cross-sectional view taken along line 3—3 of FIG. 2;

FIG. 4 is a cross-sectional view taken along line 4—4 of FIG. 3;

FIG. 5 is a cross-sectional view taken along line 5—5 of FIG. 3;

FIG. 8 is an enlarged cross-sectional view showing a portion of the inventive tive bezel setting once soldering has taken place;

FIG. 9 is a side elevational view showing the inventive bezel setting retaining a jewelry stone and permanently fixed to the ring;

DETAILED DESCRIPTION OF THE PREFERRED EMBODIMENT

Figure 1:
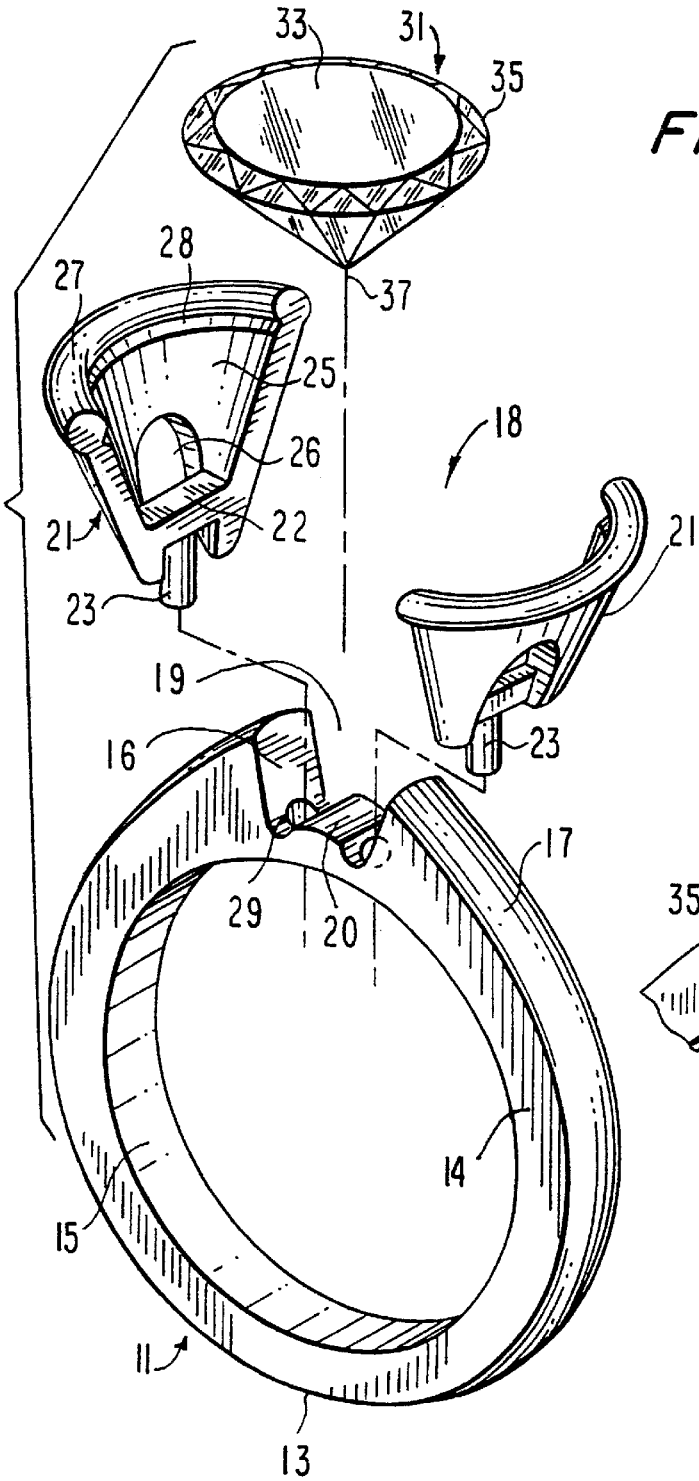
FIG. 1 is an exploded perspective view showing the various component parts of a ring assembly incorporating the inventive bezel setting.

Referring first to FIGS. 1–5, a ring assembly generally indicated at 11 and which utilizes the inventive setting 18 is described. Ring assembly 11 consists of a ring or shank 13 made from a precious metal such as gold, silver or platinum, defined by an outer surface 17, an inner ace 15 and a pair of sidewalls 14, as is well known in the art. Ring 13 is formed with a cut-out 19 in outer surface 17 in which setting 18 of the invention is received. Cut-out 19 formed in ring 13 is defined by a pair of sloped end walls 16 which lead to a separating protrusion 20, as shown in FIG. 1. Each of end walls 16 is formed with a radially inwardly extending hole 29 that is used for mounting bezel setting 18 within cut-out 19 of ring 13, as described below.

Figure 2:
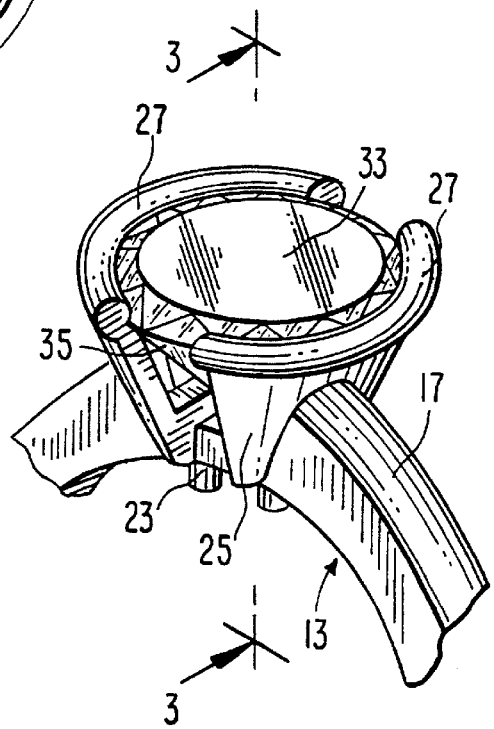
FIG. 2 is a perspective view of the inventive bezel setting mounted to a ring and retaining a jewelry stone therewithin.

Setting 18 is defined by two facing bezel elements 21 also made from a precious metal. Each bezel element 21 includes an inwardly curved member 25 (see FIG. 4) formed with a slot 26 that is sized to slidably pivot along outside surface 17 of ring 13. Curved member 25 increases in radial dimension in an upward direction and is formed with an annular running tubular lip 27. Lip 27 includes an underlying annular groove 28 in which the girdle of a stone mounted in bezel setting 18 is matingly received. Curved member 25 of each of bezel elements 21 leads to a lower axially running supporting bridge element 22 from which a depending pin 23 projects. Depending pin 23 of each of bezel elements 21 is designed for reception within holes 29 formed in cut-out 19 of ring 13, as best shown in FIGS. 2 and 3.

As is well known in the art, a jewelry stone, such as a round diamond, is generally indicated at 31 and includes a table portion 33, a girdle 35 below which is a tapered portion leading to a cutlet 37. Stone 31 is mounted within bezel elements 21 of bezel setting 18 (see FIGS. 2 and 3) such that girdle 35 is matingly received within grooves 28 of bezel elements 21, as discussed above, and cutlet 37 is disposed above bridge element 22.

Figure 7:
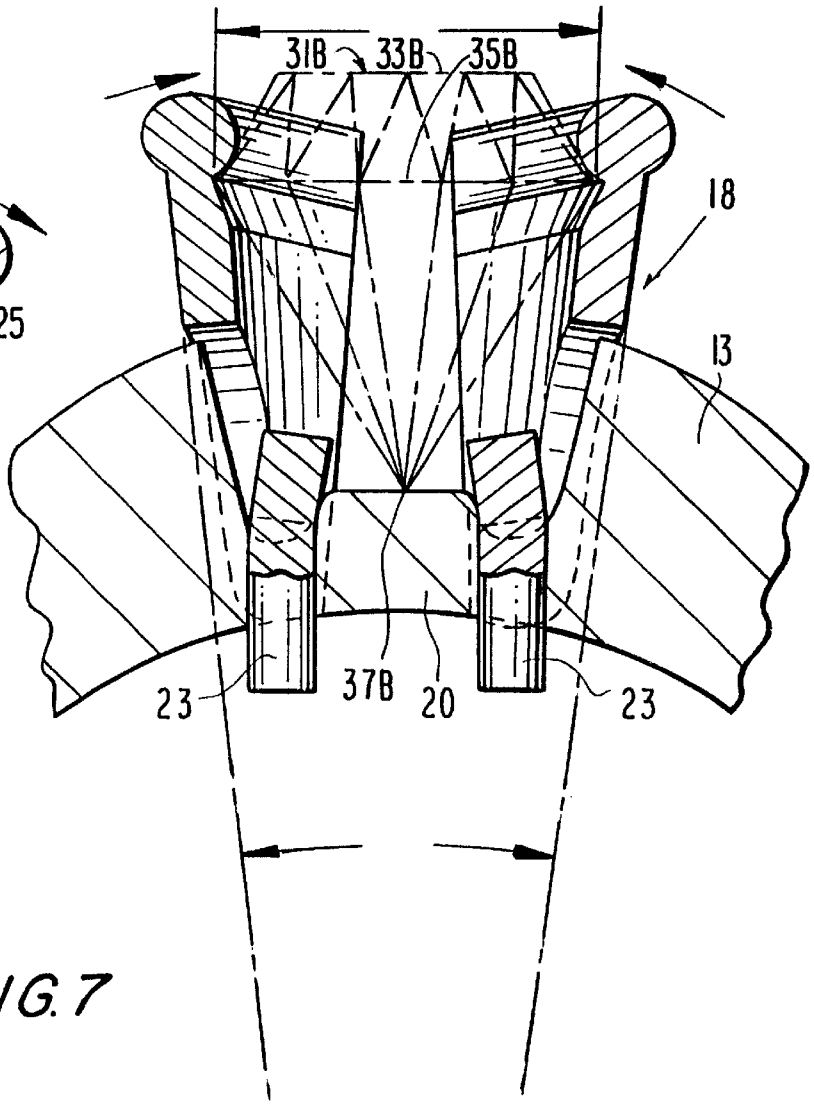
FIG. 7 is a side elevational view in partial cross-section showing the bezel elements of the inventive bezel setting being adjusted inwardly in order to accommodate a smaller size stone.
Figure 6:
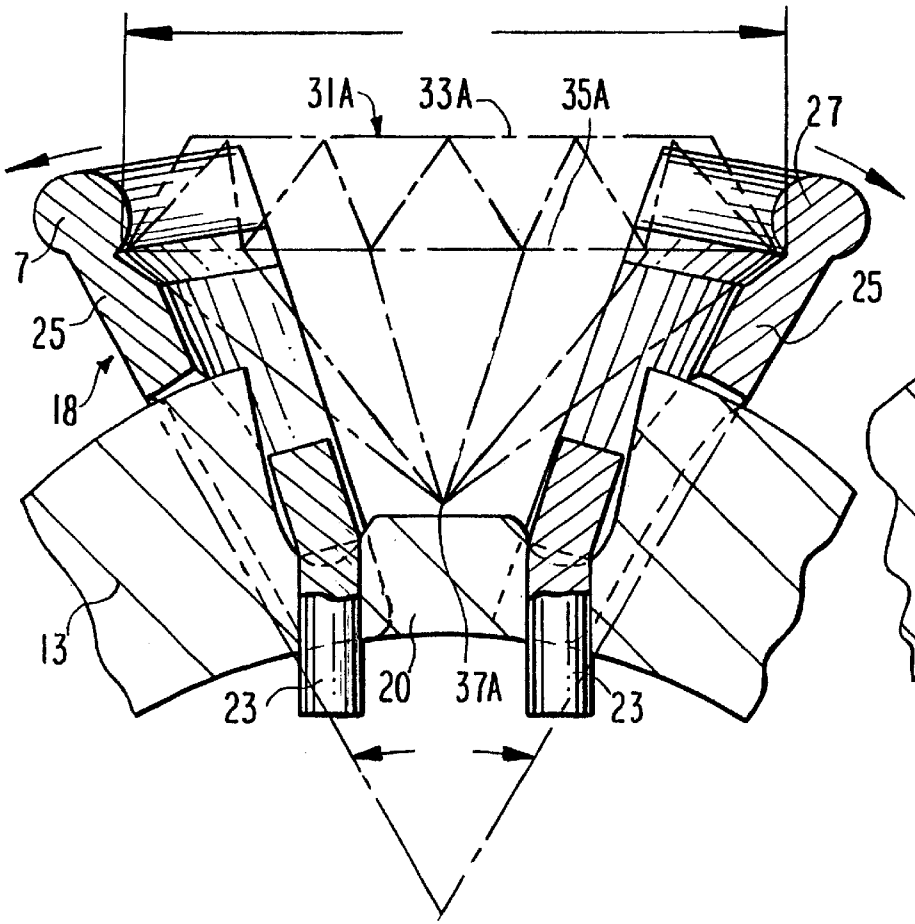
FIG. 6 is side elevational view in partial cross-section showing the bezel elements of the inventive bezel setting being outwardly adjusted in position in accommodate a larger size stone.

In order for setting 18 to accommodate varying size jewelry stones, pins 23, which are made from metal, of bezel elements 21 are selectively flexible in both forward and back directions (see FIGS. 6 and 7), such that each bezel element 21 is capable of slidably moving along ring 13 in corresponding forward and back directions. This is in part achievable since each bezel element 21 has a cut-out 26 which is shaped and sized to slidably fit over outside wall 17 of ring 13 at a location adjacent to where cut-out 19 is formed in ring 13. Accordingly, as shown in FIGS. 6 and 7, a larger size stone 33A, having a table portion 31A, girdle 35A and cutlet 37A, as well as a smaller size stone 31B, having a table portion 33B, a girdle 35B and a cutlet 37B, can be engagingly accommodated within inventive bezel setting 18.

As shown in FIGS. 8 and 9, once each of bezel elements 21 of setting 18 are slidably adjusted in position for accommodating a selected size jewelry stone, both curved member 25 and pin 23 are soldered or bonded in some other manner along end walls 16 of cut-out 19 formed in ring 13 by means of solder or bonding agent 37. A finished ring product, as shown in FIG. 9, is then achieved.

In accordance with the invention, each setting element is capable of being selectively moved back and forth to accommodate different size jewelry stones. Thus, a selected stone may be laid into the bezel setting in order to obtain a more desired fit than in conventional bezel settings. The advantage is that a buyer can see the jewelry stone in the setting as if it were set permanently therewithin, helping the buyer to envision what the jewelry item will look like when delivered to the buyer in permanent condition. In contrast, prior art bezel settings were not capable of having the stone fit correctly therein, and oftentimes the stone tends to float on top or go too low in the setting, which is less than desirable.

Figure 10:
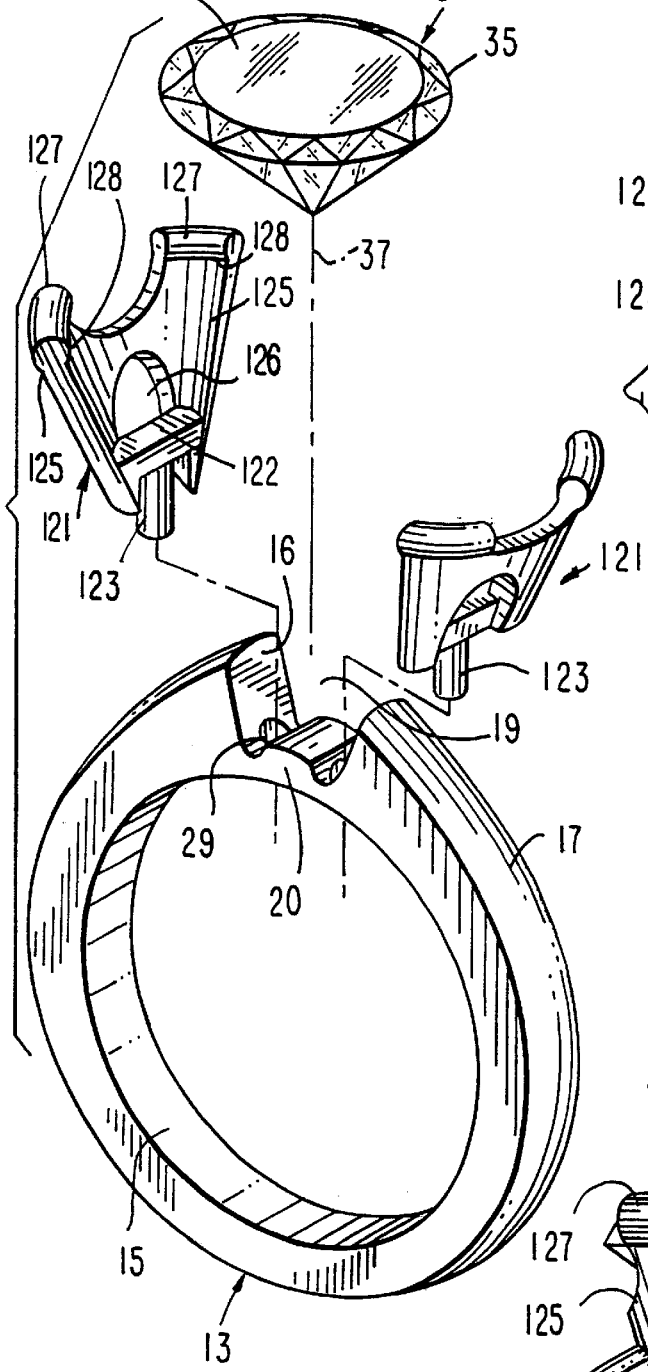
FIG. 10 is an exploded perspective view showing the component parts of a ring assembly incorporating the inventive prong setting.
Figure 11:
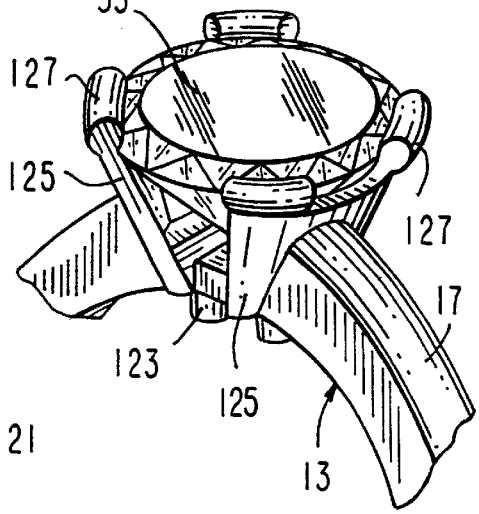
FIG. 11 is a perspective view of the inventive prong setting mounted to a ring and retaining a jewelry stone therewithin.
Figure 12:
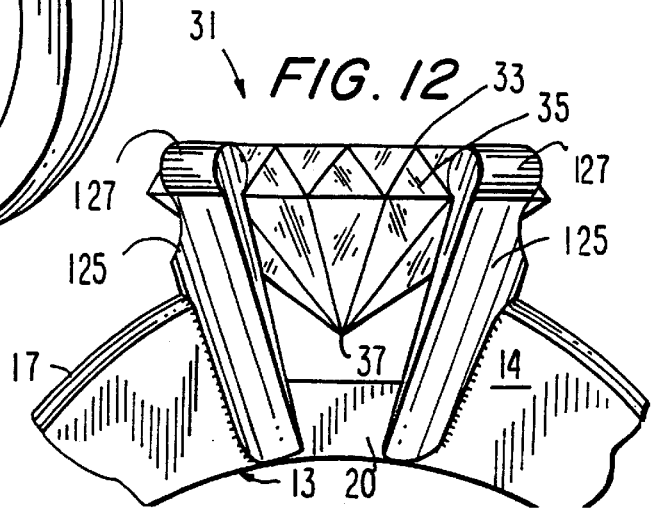
FIG. 12 is a cross-sectional view showing the inventive prong setting mounted to the ring.

Referring now to FIGS. 10–12, a prong setting is shown substituted for a bezel setting and is defined by two facing prong elements 121 made from a precious metal. Each prong element 121 includes a pair of upwardly depending prongs 125 separated by a slot 126 that is sized to slidably pivot along outside surface 17 of ring 13. Prongs 125 are each formed with a lip portion 127 at the top end thereof. Lip portion 127 of each prong 125 includes an underlying annular groove 128 in which girdle 35 of stone 31 mounted in the prong setting is matingly received. Prongs 125 of each of prong elements 121 leads to a lower axially running supporting bridge element 122 from which a depending pin 123 projects. Depending pin 123 of each of prong elements 121 is designed for reception within holes 29 formed in cut-out 19 of ring 13, as best shown in FIG. 11. As with the first embodiment of the invention, pins 123 of prong elements 121 are selectively flexible in both forward and back directions such that prong elements 121 are capable of slidably moving along ring 13 in corresponding forward and back directions.

It will thus be seen that the objects set forth above, among those made apparent from the preceding description, are efficiently attained, and since certain changes may be made in the invention described herein without departing from the spirit and scope of the invention, it is intended that all matter contained in the above description shall be interpreted as illustrative and not in a limiting sense.

It is also to be understood that the following claims are intended to cover all of the generic and specific features of the invention described herein, and all statements of the scope of the invention which, as a matter of language, might be said to fall therebetween.

What is claimed is:

1. A jewelry assembly comprising:

a jewelry element and a setting for retaining a jewelry stone of varying size and being mounted to said jewelry element;

wherein said setting comprises a first setting element and a second setting element, which together define an opening therebetween, said setting elements being movable with respect to one another along said jewelry element in order to selectively adjust the distance therebetween so as to either increase or decrease in size said opening for accommodating said varying size jewelry stone.

2. The assembly of claim 1, wherein said setting elements are pivotally movable with respect to one another along said jewelry element.

3. The assembly of claim 2, wherein each of said setting elements includes a depending flexible pin element coupled to said jewelry element.

4. The assembly of claim 3, wherein each said pin is received in a hole formed in said jewelry element.

5. The assembly of claim 1, wherein said jewelry element is formed with a cut-out in which said setting is received for mounting thereto.

6. The assembly of claim 1, wherein each said setting element is formed with a slot for slidably engaging said jewelry element such that said setting elements are slidably moveable with respect to one another along said jewelry element.

7. The assembly of claim 1, wherein said jewelry element is a ring.

8. The assembly of claim 1, wherein said setting is permanently mounted to said jewelry element following adjustment of the distance between said setting elements by means of one of bonding and soldering.

9. The assembly of claim 1, wherein each said setting element includes at least one engaging prong.

10. A jewelry system comprising:

a plurality of jewelry stones of varying size;

a jewelry element and a setting for retaining any of said stones and being mounted to said jewelry element;

wherein said setting comprises a first setting element and a second setting element, which together define an opening therebetween in which any one of said stones is received, said setting elements being movable with respect to one another along said jewelry element in order to selectively adjust the distance therebetween so as to either increase or decrease in size said opening for accommodating said any one of said stones.

11. The system of claim 10, wherein said setting elements are pivotally movable with respect to one another along said jewelry element.

12. The system of claim 11, wherein each of said setting elements includes a depending flexible pin element coupled to said jewelry element.

13. The system of claim 12, wherein each said pin is received in a hole formed in said jewelry element.

14. The system of claim 10, wherein said jewelry element is formed with a cut-out in which said setting is received for mounting thereto.

15. The system of claim 10, wherein each said setting element is formed with a slot for slidably engaging said jewelry element such that said setting elements are slidably moveable with respect to one another along said jewelry element.

16. The system of claim 10, wherein each of said jewelry stones includes a girdle and each said setting element includes at least one groove for engaging said girdle when any one of said stones is received in said setting.

17. The system of claim 10, wherein said jewelry element is a ring.

18. The system of claim 10, wherein said setting is permanently mounted to said jewelry element following adjustment of the distance between said setting elements by means of one of bonding and soldering.

19. The system of claim 10, wherein each said setting element includes at least one engaging prong.

20. A jewelry setting for retaining a jewelry stone of varying size and being mountable to a jewelry element, said setting comprising a first setting element and a second setting element, which together define an opening therebetween in which said stone may be received, said setting elements being movable with respect to one another along said jewelry element when mounted thereto in order to selectively adjust the distance therebetween so as to either increase or decrease in size said opening for accommodating said varying size jewelry stone.

21. The setting of claim 20, wherein said setting elements are pivotally movable with respect to one another along said jewelry element when mounted thereto.

22. The setting of claim 21, wherein each of said setting elements includes a depending flexible pin element for coupling to said jewelry element.

23. The setting of claim 20, wherein said setting is sized for being mounted within a cut-out formed in d jewelry element.

24. The setting of claim 20, wherein each said setting element is formed with a slot sized for slidably engaging said jewelry element such that said setting elements may be slidably moved with respect to one another along said jewelry element.

25. The setting of claim 20, wherein each said setting element includes at least one groove for engaging a girdle of said stone when received in said setting.

26. The setting of claim 20, wherein said setting is designed to be permanently mounted to said jewelry element following adjustment of the distance between said setting elements by means of one of bonding and soldering.

27. The setting of claim 20, wherein each said setting element includes at least one engaging prong.

* * * * *